United States Patent [19]

Tan

[11] Patent Number: 4,560,088

[45] Date of Patent: Dec. 24, 1985

[54] VENDING MACHINE WITH DISPENSING OPERATING SYSTEM MOVABLE IN X-Y COORDINATE AXES

[76] Inventor: Larry K. Tan, 1347 Castlemont Avenue, Apt. 1, San Jose, Calif. 95128

[21] Appl. No.: 609,324

[22] Filed: May 11, 1984

[51] Int. Cl.[4] ..... G07F 11/36

[52] U.S. Cl. ..... 221/75; 221/129; 414/278

[58] Field of Search ..... 221/75, 88, 126, 129, 221/130, 131, 195, DIG. 1; 414/257, 278

[56] References Cited

U.S. PATENT DOCUMENTS

| | | | |
|---|---|---|---|
| 3,002,602 | 10/1961 | Giepen | 194/10 |
| 3,178,055 | 4/1965 | Schuller | 221/75 |
| 3,294,281 | 12/1966 | Schlaf | 221/9 |
| 3,344,953 | 10/1967 | Krakauer et al. | 221/75 |
| 3,355,064 | 11/1967 | Schlaf | 221/14 |
| 3,692,211 | 9/1972 | Flubacker | 221/9 |
| 3,750,804 | 8/1973 | Lemelson | 414/278 X |
| 3,756,432 | 9/1973 | McCreary | 414/257 X |
| 4,023,704 | 5/1977 | Pitel et al. | 221/75 |
| 4,039,785 | 8/1977 | Ziemann | 221/129 X |
| 4,354,613 | 10/1982 | Desai et al. | 221/4 |

FOREIGN PATENT DOCUMENTS

| | | | |
|---|---|---|---|
| 52-43498 | 4/1977 | Japan | 221/129 |

*Primary Examiner*—F. J. Bartuska

*Attorney, Agent, or Firm*—Stephen F. K. Yee

[57] ABSTRACT

A vending machine having a plurality of helically-wound dispensing coils with merchandise items disposed between adjacent coil convolutions is provided with a coil operating system movable along X-Y axes. A first drive motor rotates a vertically-oriented shaft to reciprocate a traveler movable thereon and supporting a horizontally-disposed member. A second drive motor and a counter-balancing weight, mounted adjacent to the ends of the member, are interconnected by a second shaft rotatably secured to the second motor and the weight. A horizontally-movable traveler carrying a dispensing coil actuator reciprocates along the second shaft. A control unit responds to signals from a coin-operated merchandise selector to move both travelers, vertically and horizontally, respectively, to position the actuator adjacent to the dispensing coil for the selected item. Operation of the actuator motor rotates the coil to dispense the item.

27 Claims, 6 Drawing Figures

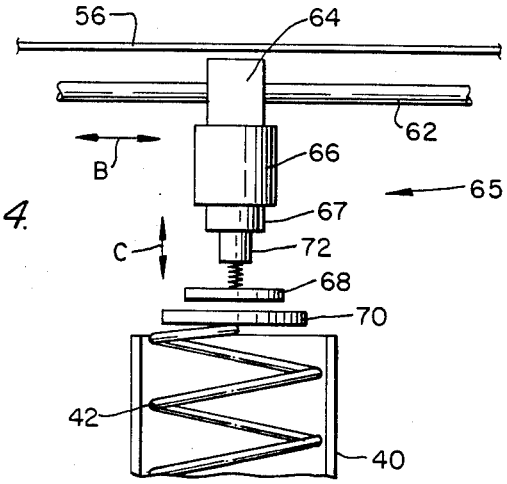
FIG. 4.
FIG. 5.
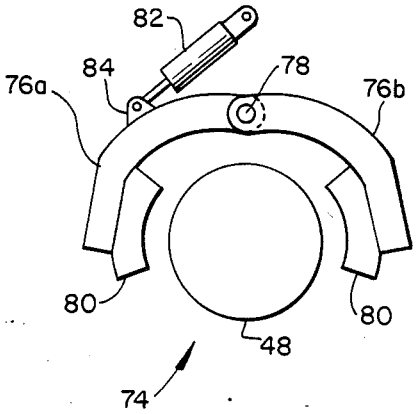
FIG. 6.
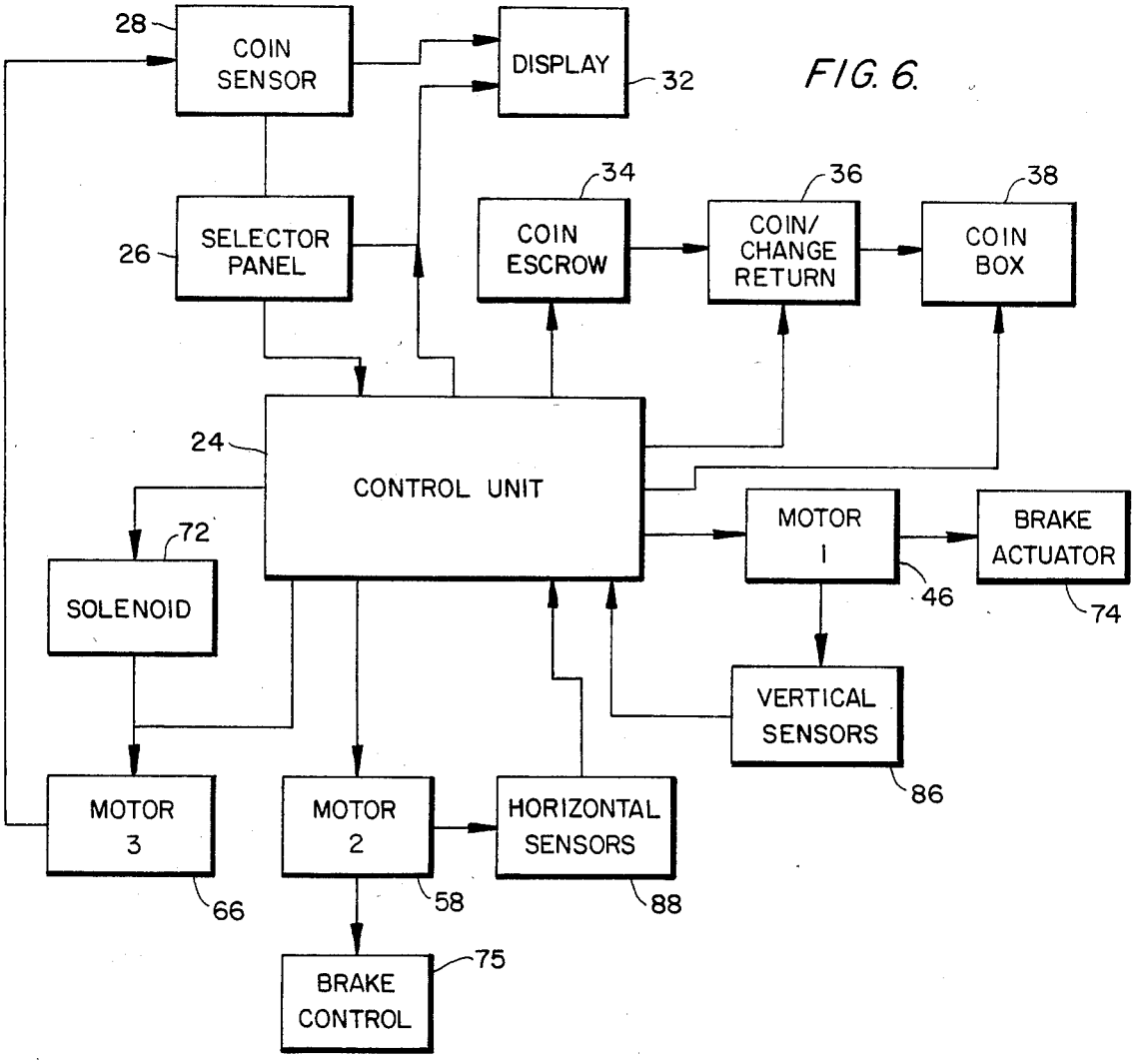

VENDING MACHINE WITH DISPENSING OPERATING SYSTEM MOVABLE IN X-Y COORDINATE AXES

BACKGROUND OF THE INVENTION

1. Field of the Invention

This invention generally relates to article dispensing or vending machines and is more particularly directed to an improved dispensing operating mechanism for such machines.

The types of vending machines to which the present invention is directed, while of general application, are particularly well suited for use in the delivery of successive articles to the discharge portion of the machine upon operation of a coin-activated control mechanism. The type of vending machine to which the present invention is particularly suited customarily includes a plurality of helical dispensing coils disposed within the housing of the machine, with the articles to be vended being located between adjacent convolutions of the coil such that, upon rotation of a particular coil in response to actuation of the operating control mechanism, one of the articles is discharged toward the delivery opening where it is available to the purchaser.

2. Prior Art

The foregoing types of vending machines are well known in the prior art. Examples are described in U.S. Pat. Nos. 4,354,613, 4,023,704, 3,355,064, 3,344,953 and 3,178,055. Generally, in these machines a number of helical springs or coils are disposed side-by-side in a row, with articles to be dispensed being positioned between adjacent turns of the spring such that rotation of a specific spring dispenses the selected article to the purchaser. Additional rows of springs may be superposed within the machine to increase the number and variety of articles which may be dispensed.

Each of the helical springs is provided with an actuator, generally a motor, under the control of a coin-operated system which, upon actuation, rotates the spring to advance the foremost article into a delivery chute. With a separate actuator motor provided for each spring, the dispensing operating mechanism and the control system therefor becomes complex, which increases the cost of the vending machine and adversely affects the reliability of its operation.

Attempts have been made to reduce the complexity of the dispensing operating system, and examples are described in U.S. Pat. No. 3,692,211, issued to Flubacker and U.S. Pat. No. 3,294,281, issued to Schalaf. In the Flubacker patent, individual actuators for each row of items to be dispensed are replaced by a single actuator supported on a rail carriage to permit positioning of the actuator at the desired location for dispensing of a single item. Instead of helical coils, Flubacker utilizes a plurality of latches to support the individual items, with each latch being released by the selectively-positionable movable actuator.

In the Schalaf patent, the indivdual motor for each coil has been replaced with a solenoid-engageable, rotation-inducing mechanism, with all of the mechanisms being connected by a common chain driven by a single motor. Operation of the control system energizes the solenoid coupled to the selected coil to connect the rotation-inducing device to the coil which is then rotated by the driven chain.

The patent to Giepen, U.S. Pat. No. 3,002,602, illustrates another attempt to reduce the number of operating devices in a vending machine capable of dispensing a large number of items. Giepen provides a plurality of bins connected to a conveyor system driven by a single motor, each bin having several stories or tiers for receiving the items to be dispensed. The control system positions the selected bin adjacent to an elevator unit, at which position activation of an ejector unit, which may be driven by a single motor or a plurality of vertically-positioned motors, ejects the selected item into an elevator mechanism, and operation of the elevator drive motor lifts the selected item upwardly to be dumped into a delivery chute.

The foregoing attempts to reduce the number of individual actuators have not been entirely successful, and the resulting apparatuses remain complex devices.

Although not related directly to vending machines, the article handling apparatuses used in the warehousing of a large number of articles stored in multiple, tiered rows function to position an article in a specified location. In the article handling system described in the patent to Ziemann, U.S. Pat. No. 4,039,785, a crane-like handling device is moved between storage rows by a drive motor which positions the device at the desired column of storage. A second motor moves the device vertically to place the crane opposite the desired tier of storage, and a third motor operates the crane to place or to remove the item from the storage location. A computer controls the operation of the apparatus.

Although X-Y coordinate type article handling apparatuses have been used in warehousing, such as described in the Ziemann patent, these apparatuses are large-scale devices capable of handling heavy, bulky items, and do not lend themselves to an application in a vending machine. The Applicant is not aware of a dispensing operating system having a minimum number of actuators capable of movement in an X-Y coordinate fashion which is controllably movable vertically to a desired row of vended items, horizontally along the selected row to the desired dispensing coil and subsequently operable to rotate the dispensing coil to dispense the selected item.

SUMMARY OF THE INVENTION

It is an object of the present invention to provide a vending machine with an improved dispensing operating system having substantially fewer dispensing actuators than existing similar machines.

Another object of the invention is to provide a vending machine of the foregoing type capable of dispensing a large selection of different items with a plurality of helical dispensing coils, each of which are selectively operable by the dispensing operating system.

Another object of the invention is to provide a vending machine of the foregoing type in which the components of the dispensing operating system are selectively movable in a substantially X-Y coordinate fashion to position a dispensing coil actuator in a desired location.

Further objects of the invention are to provide a vending machine of the foregoing type having motive mechanism to move vertically and horizontally a dispensing coil actuator in an X-Y coordinate fashion to controllably position the actuator in a desired location to operate a dispensing coil; to provide a dispensing operating system of the foregoing type which is responsive to a coin-actuated controller; to provide a dispensing operating system of the foregoing type having an array of position sensors which are actuated to provide location and positioning signals for the system; and to provide a dispensing operating system having braking mechanisms to assist in positioning precisely a dispensing coil actuator.

These and other objects of the invention are provided in a vending machine of the plural dispensing coil type having a dispensing operating system which includes a first driving mechanism operable to move a dispensing coil actuator vertically and a second driving mechanism operable to move the actuator horizontally, in a X-Y coordinate fashion to position the actuator adjacent a selected dispensing coil. Sensors in an array are responsive to passage of components of the operating system to provide signals used to locate and to position the actuator, and braking mechanisms function in conjunction with the driving mechanisms to precisely position the actuator in the desired location. Once in position, the dispensing coil actuator is operated to rotate the coil to dispense the selected item of merchandise. Operation of the vending machine and the dispensing operating system is regulated by a control unit.

BRIEF DESCRIPTION OF THE DRAWINGS

FIG. 4 is a plan view of the dispensing coil actuator mechanism of the dispensing operating system;

FIG. 5 is a plan view showing an illustrative embodiment of a braking apparatus which may be incorporated into the dispensing operating system; and FIG. 6 is a functional block diagram illustrating the operation of the system.

DETAILED DESCRIPTION

Figure 2:
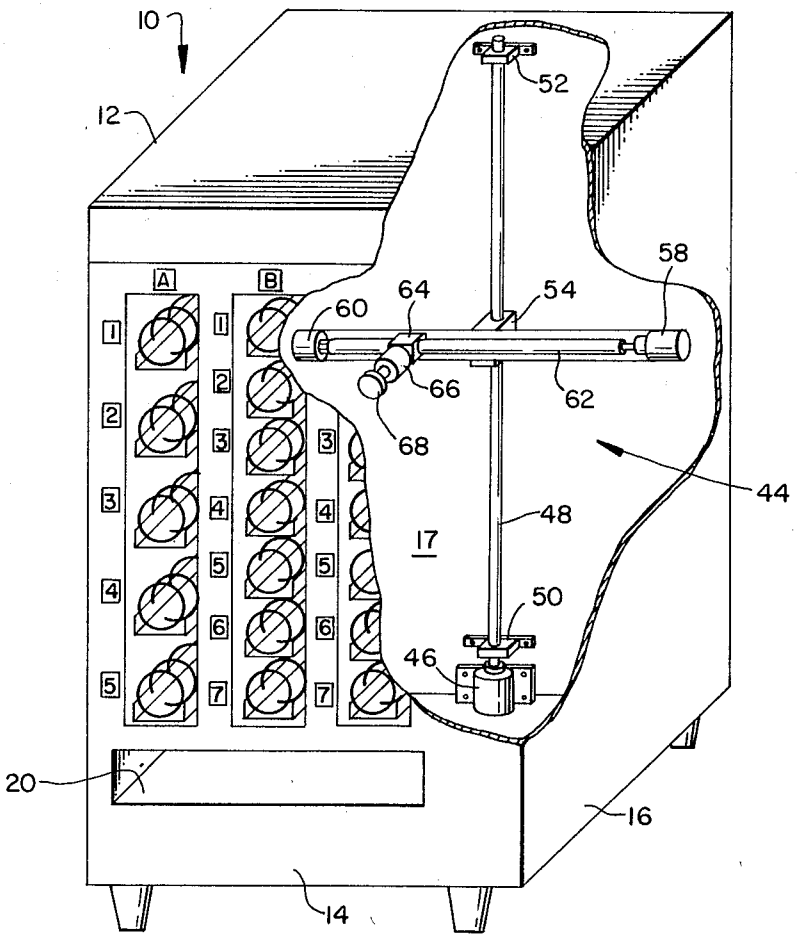
FIG. 2 is a front perspective view similar to FIG. 1, partly sectioned to show components of the dispensing operating system, with some components omitted for greater clarity of the view.
Figure 1:
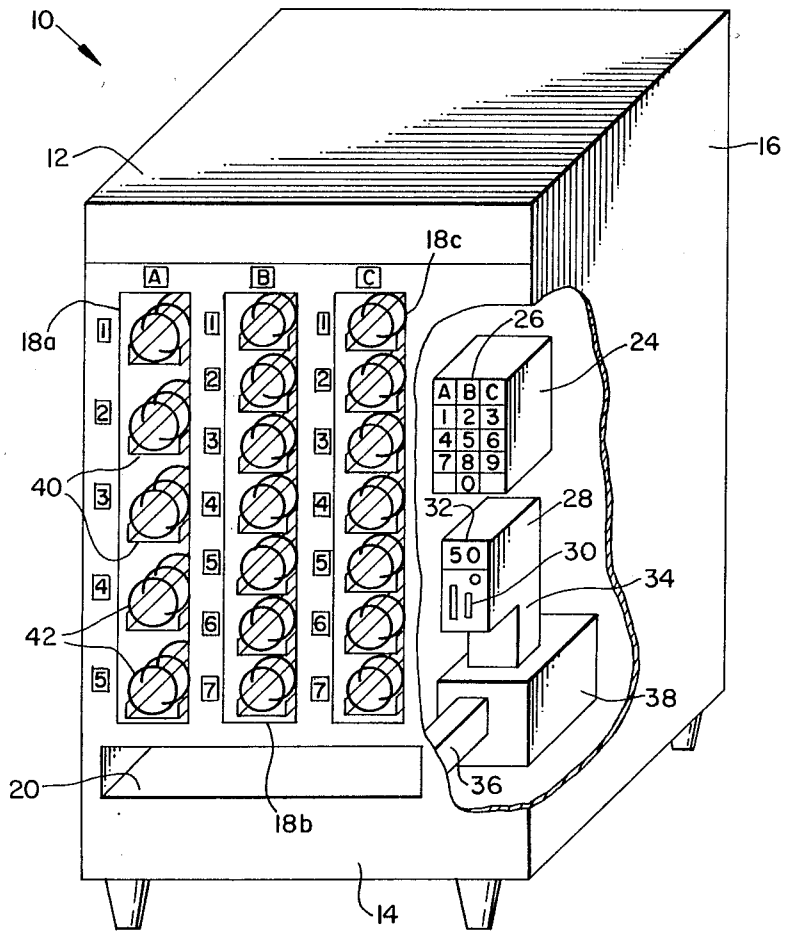
FIG. 1 is a front perspective view of a vending machine in accordance with an illustrative embodiment of the present invention, partly sectioned to show some of the internal components.

With reference to FIGS. 1 and 2, a vending machine 10 which incorporates the dispensing operating system of the present invention includes a cabinet or housing 12 having a front panel 14, side panels 16 (one visible), a back panel 17 and a bottom which is not visible in the figures. The front panel 14 is hinged to permit access to the interior of the cabinet 12, and may include windows 18*a*–18*c* through which the merchandise may be viewed. An opening 20 adjacent to the lower portion of the front panel 14 provides access to the delivery chute (not visible) to which the dispensed article is delivered.

Portions of the front panel 14 and a side panel 16 have been sectioned to show some of the components located within the cabinet 12. A control unit 24 which controls the operation of the vending machine 10 is connected to a selector panel or keyboard 26 provided on the front panel 14. A coin sensing unit 28 of a known type is provided with several slots 30 into which coins are inserted. The coin sensing unit 28 includes known means for sensing different denominations of coins, with the value of deposited coins being shown on a display or read-out 32. The coin sensing unit 28 also includes an escrow device 34 which temporarily retains the deposited coins and upon receipt of a signal from the control unit 24, the coin sensing unit 28 operates to direct the coins in the escrow device to a coin return 36 or to a coin box 38. Change is also directed to the coin return 36 by the coin sensing unit 28 under the control of the control unit 24.

Disposed within the interior of the cabinet 12, and visible through the windows 18*a*–18*c*, are a plurality of trays 40 which are arranged side-by-side on horizontally-disposed shelves, with several shelves stacked or tiered vertically. Each tray 40 is provided with a dispensing or feeding coil 42 formed as a helically-wound spring. Note, also, FIGS. 3 and 4. The items of merchandise I to be vended are placed between successive windings of the coil and as explained more fully below, the dispensing operating system of the present invention rotates the selected coil one turn to advance the foremost item to the front edge of the tray, where it drops into the delivery chute for access by the purchaser through the opening 20 in the front panel 14 of the cabinet 12.

Each tray 40 within the cabinet 12 is identified, such as by column and row, to correspond with the indicia on the selector panel, and the tray location is noted along the edges of the windows 18*a*–18*c*, as shown in FIG. 1.

Figure 3:
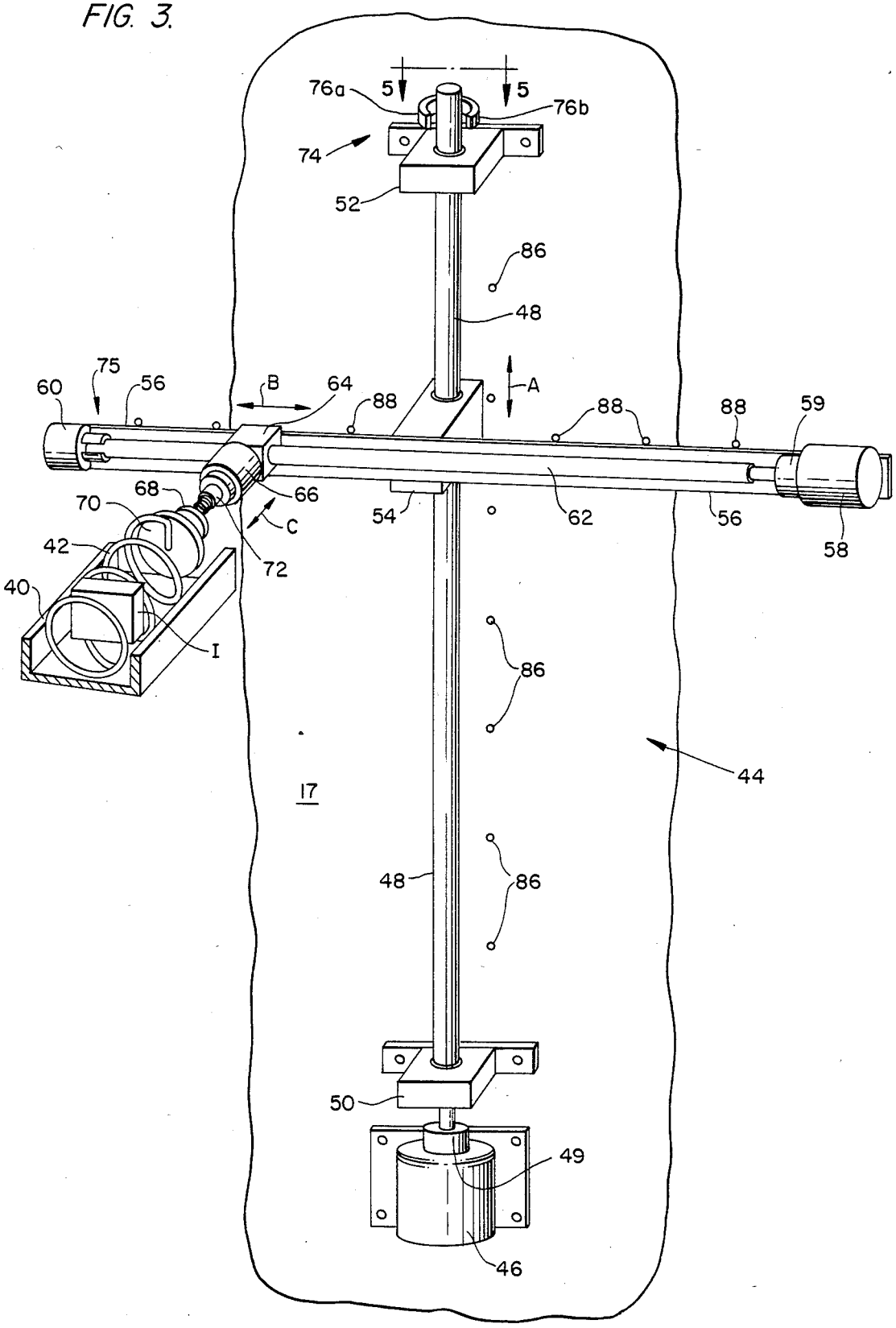
FIG. 3 is a front perspective view of the dispensing operating system in accordance with the present invention.

In FIG. 2, the cabinet 12 has been sectioned to show the major components comprising the dispensing operating system 44 of the present invention, which is shown in more detail in FIG. 3. The system 44 is disposed toward the back portion of the cabinet 12, and includes a first motor or driver 46 connected to a shaft 48 by a flexible coupler 49. The shaft 48 is rotatably supported against the back panel 17 of the cabinet 12 by a bearing 50 at its lower end, adjacent to the motor 46, and by a bearing 52 adjacent to its upper end. A linear actuator or traveler 54 is supported on the shaft 48 for rectilinear movement along the longitudinal axis of the shaft, as indicated by the double-headed arrow A, when the shaft is rotated by the motor 46.

Supported on the linear actuator 54 is a horizontally-disposed support 56, and attached at one end of the support is a second motor or driver 58 and attached at the other end is a counter-balancing weight 60. A second shaft 62 is rotatably coupled at one end to the second motor 58 via a flexible coupler 59 and rotatably received at the other end within a bearing (not visible) in the counter-balancing weight 60.

With reference to FIGS. 3 and 4, supported on the shaft 62 is a second linear actuator or traveler 64 which reciprocates along the longitudinal axis of the shaft 62, in the directions indicated by the double-headed arrow B, upon rotation of the shaft by the motor 58. Mounted on the linear actuator 64 is a dispensing coil actuator 65 which includes a motor or driver 66 connected to a clutch plate or disk 68 which is extendable to engage a corresponding clutch plate or disk 70 attached to one end of the dispensing coil 42. Extension and retraction of the clutch disk 68 into and out of engagement with the clutch disk 70, as indicated by the arrow C, is achieved with a solenoid 72 having its ends attached respectively to the motor 66 and the clutch disk 68.

As shown in FIG. 3, the dispensing coil 42 is rotatably disposed within the tray 40, and the items I to be dispensed (one shown) are received within adjacent turns of the coil. The end of the coil 42 is securely attached to the one surface of the clutch disk 70. The opposing surfaces of the clutch disks 68 and 70 are coated with a friction material to improve engagement between the surfaces. It is understood that the tray 40, with its associated dispensing coil 42, is slidable upon a support shelf (not shown) to permit the tray to be slid out from the cabinet 12 for convenient loading of the merchandise, and the clutch disk 70 secured to the end of the coil readily permits the tray to be slid in and out of the cabinet without interference from the coil actuator 65. It is understood that, while not shown in the drawings, the dispensing coil 42 is rotatably supported in the tray 40 by appropriate means.

Each of the drive motors 46, 58 and 66 may be of the AC or DC type, and comprise a known type of positive brake motor which stops substantially instantaneously such that the motor shaft can not rotate more than a predetermined range after the power is shut off. For increased control in the precise positioning of the linear actuators 54 and 64, each of the drive motors may be provided with an electric brake solenoid which is normally de-energized, upon energy to the motor being stopped, by a suitable brake relay to release the brake and arrest motor rotation by a suitable means, such as a friction disk pressed against a rotating member of the motor. Both the positive brake type motor and the motor with an electrical brake solenoid and brake element are known in the art and their further description is not deemed necessary.

Another method of instantaneously stopping rotation of the shafts 48 and 62 is shown in FIG. 3. A brake 74 is positioned on the end of shaft 48 extending above the bearing 52. As shown more fully in FIG. 5, brake 74 includes arcuate frame members 76*a* and 76*b* which are joined at a pivot 78 to permit pivotal motion of each frame member towards and away from the surface of the shaft 48. A resilient friction member 80 is secured to the inner surface of each frame member 76*a, b,* adjacent to the shaft 48, and an electrically-actuated solenoid 82 is secured to one of the frame members, such as at a point 84 of member 76*a*. Not shown in the drawings is a biasing member which, with the solenoid 82 deactivated, urges the frame members 76*a, b,* toward each other, to press the friction members 80 against the surface of the shaft 48, to substantially stop instantaneously the rotation of the shaft.

Suitable electrical control means, including a relay coupled to the solenoid 82, is provided in the control system such that when the motor 46 is energized, the solenoid 82 is also energized to retract the frame members 76*a,* 76*b* away from the shaft 48. When energy to the motor 46 is stopped, the solenoid 82 is also de-energized, permitting the biasing member to force the friction members 80 against the surface of the shaft 48 to stop its rotation.

Of course, any other suitable interconnection between the energizing of the motor 46 and the solenoid 82 is within the scope of this disclosure. Thus, the energization of the drive motor 46 and the solenoid 82 may be the reverse of the sequence described above, so that when the motor is energized, the solenoid is de-energized, with the biasing element operating to maintain the brake inoperative, that is maintaining the friction members 80 away from the surface of the shaft 48. In this case when the motor is de-energized, then the solenoid 82 is energized to press the friction members 80 against the shaft 48.

As noted above, a brake 75, which is structurally identical to brake 74, is provided to stop the rotation of the shaft 62 when the motor 58 is de-energized.

While the brakes 74 and 75 may be located anywhere along the length of the respective shaft 48 and 62, the preferred location is adjacent to the end of the shaft opposite the respective drive motor. The location of the brake at the end of the shaft cooperates with the de-energized motor to stop rotation of the respective shaft almost instantaneously.

To assist in the location or mapping of the linear actuators 54 and 64, a column of sensors 86 is spaced vertically, adjacent to the longitudinal axis of the shaft 48 such that the position of each of the vertical sensors corresponds substantially to the vertical location of each horizontal row of dispensing trays 40. A row of sensors 88 is mounted on the horizontal support 56, with the spacing of each of the sensors corresponding to the location of a tray 40 within a row of trays.

Each of the linear actuators 54 and 64 is provided with a mechanism which responds to the sensors so that an appropriate signal is provided to the control unit 24 as each actuator passes a sensor. Each sensor may comprise a light source, such as a LED, with a cooperating photocell or photodetector provided on each of the linear actuators 54 and 64. As the respective linear actuator passes over the light source, the photodetector will be triggered to send the appropriate signal to the control unit 24. Alternatively, instead of a photo-activated system, an array of microswitches may be substituted such that as each of the linear actuators 54 and 64 passes over a microswitch location, the switch will be energized and an appropriate signal provided to the control unit 24 which is representative of the vertical and horizontal location of the respective actuators.

The exact location of each of the sensors 86 and 88 relative to each tray 40 is determined appropriately to accurately locate linear actuators 54 and 64, and thus the coil actuator 65, relative to the clutch disk 70 on each coil 42. For example, each of the sensors 86 may be vertically spaced to locate the linear actuator 54 such that the horizontal shaft 62 is parallel to a horizontal centerline joining all the clutch disks 68 in a row. Each of the sensors 88 may be spaced along the support 56 to locate the actuator 65 such that the clutch disk 68 is directly opposite the clutch disk 70 attached to a coil 42.

The operation of the vending machine 10 and the dispensing operating system 44 will be described with reference to the functional block diagram of FIG. 6. The desired item of merchandise will be chosen by the purchaser according to the column and row of that item, as shown by the column and row identifiers placed on the face of the front panel 14, such as the A, B and C column identifiers and the numerical 1, 2, etc., row identifiers located adjacent to the merchandise, together with the price of the item. The cumulative value of the coins inserted into the slots 30 will be noted by the coin sensing unit 28 and displayed on the readout 32. The deposited money is held within the escrow device 34 until completion of the transaction, either by returning all the deposited money to the purchaser through the coin return 36 or by dispensing of the selected item, together with any change that should be returned, after which the money is discharged to the coin box 38.

After the money has been deposited, the desired item is selected by depressing the appropriate buttons on the face of the selector panel 26, by the appropriate column and row designation corresponding to the identifier adjacent to the desired item on the face of the panel 14. The value of the deposited coins held in escrow is compared with the cost of the selected item, which is stored in the memory of the control unit 24, and if these two numbers are equal, the control unit generates the appropriate signals to activate the dispensing control system 44, and if the amount deposited is greater than the cost of the selected item, an appropriate signal is sent to the coin return 36 to dispense the correct change along with the purchased item. If the amount in the escrow device 34 is less than the cost of the selected item, an appropriate signal is produced to request the deposit of additional money, such as by flashing of the readout 32 or illumination of some other appropriate indicator on the front panel 14.

Also stored within the memory of the control unit 24 is the location data for each dispensing tray 40 within the vending machine 10. Selection of the desired tray 40 with the selector panel 26 causes the control unit 24 to retrieve the proper location data which is used to control the operation of the dispensing operating system 44.

With the appropriate activation signals from the control unit 24, drive motors 46 and 58 are operated, either sequentially or, preferably, simultaneously. Upon activation of the drive motors 46 and 58, the respective brake units 74 and 75 are operated to release the friction members 80 from engagement with the respective shaft 48 or 62 to permit shaft rotation. Rotation of the drive motor 46 in the appropriate direction causes the linear actuator 54 to move either up or down, as determined by the location data control signals produced by the control unit 24, to place the horizontally-disposed shaft 62 in alignment with the row in which the desired item is stored. Subsequently, or substantially simultaneously, rotation of the drive motor 58 in the desired direction causes the linear actuators 64 to move along the longitudinal axis of the shaft 62 to align the dispensing coil actuator 65 with the dispensing coil 42 in the desired tray 40. Stopping of the respective motor 46 or 58 causes the respective brake 74 or 75 to clamp the frictional elements 80 onto the respective shaft, thus cooperating with the non-rotating motors to stop instantaneously further rotation of the shaft. These coordinated actions accurately places a dispensing structure associated with the linear actuator 64 in the column and row location for the item to be disposed.

It is understood that in operation, the vertical position of the linear actuator 54, as determined by the appropriate vertical position sensors 86, is used by the control unit 24 and compared with the stored vertical position or row location data in which the desired item is located. Similarly, the horizontal position of the actuator 64, as determined by activation of the appropriate sensor 88, is compared by the control unit 24 with the stored horizontal location data of the tray in which the desired item is located. These input data from the sensors are utilized by the control unit 24 to control operation of the respective drive motors 46 and 58, and their associated brakes 74 and 75, to accurately position the coil rotating motor 66.

The control unit 24 next energizes the solenoid 72 to extend the motor 66 toward the clutch disk 70 secured to the dispensing coil 42. Upon contact being established between the clutch disks 68 and 70, the motor 66 is operated to rotate the clutch disk 68 sufficiently to impart one complete revolution to the dispensing coil 42, or otherwise sufficiently to advance the foremost item I in the coil toward the front edge of the associated tray 40, permitting the item to drop by gravity into the delivery chute, to which the purchaser may obtain access from the opening 20 in the front panel 14 of the vending machine 10.

The control unit 24 may be programmed to operate the solenoid 72 and the motor 66 sequentially, as described above, or substantially simultaneously, or in any appropriate sequence, provided that the dispensing coil 42 is rotated only sufficiently to discharge one item from the tray 40.

An appropriate sensor, such as a photocell system, may be provided adjacent to the delivery chute to indicate when the purchased item has been dispensed, to provide the appropriate signal to the control unit 24 which then cycles the dispensing operating system 44 back to a beginning condition, ready for the selection of the next purchase.

The circuitry for the control system is of the closed-loop type. After the purchased item has been disposed, the control unit 24 returns the linear actuators 54 and 64 to their respective reset or home positions. For the actuator 54, the home position is the position of the lowermost sensor 86, and for the actuator 64 the home position is the position of the far right (FIG. 3) sensor 88. For each purchase, the actuators 54 and 64 will start from their home positions to ensure consistent accuracy in locating the dispensing coil actuator 65 adjacent to the desired tray 40.

Since the available items can be seen through the windows 18*a*–18*c*, a visible "sold out" indicator would notbe required. However, to prevent undesired operation of the dispensing operating system 44, an appropriate sold-out sensor may be provided for each dispensing tray 40, which is coupled to the control unit 24 such that selection of a sold-out item activates an appropriate visual indicator and prevents operation of the dispensing operating system. Various types of these safeguard units are known in the art and are commerically available.

Although FIG. 3 shows the dispensing operating system 44 with the vertically-oriented shaft 48 disposed substantially in the center of the back panel of the vending machine 10, with the horizontally-movable actuator 64 traversing left or right, the shaft may be located off-center, to the left or the right in FIG. 3, such that the linear actuator 64 is supported in a cantilevered manner from the vertically-movable linear actuator 54. Also, braking elements other than those described above may be incorporated into the operating system to ensure substantially instantaneously stopping of the linear actuators for increased accuracy in locating the dispensing coil actuator 65. A threaded shaft, or lead-screw, and a cooperating nut may be used in place of the shaft 48-linear actuator 54 and shaft 56-linear actuator 64 arrangement in the dispensing operating system 44.

It will be apparent to those skilled in the art that the dispensing operating system disclosed herein may be used with a dispensing mechanism other than a rotatable coil. The dispensing coil actuator may, for example, be adapted to operate other types of article releasing and dispensing devices.

Although not specifically illustrated in the drawings, it is understood that all of the components described above are arranged and cooperate in a manner to form a complete and operative system. Further, it is understood that all ancillary components, such as power and connecting lines, switches, etc., have not been specifically described, but such components are known and would be appropriately incorporated into the operative system.

Of course, additional variations of the specific construction and arrangement of the disclosed invention can be made by those skilled in the art without departing from the invention as defined in the appended claims.

What is claimed is:

1. In combination with a vending machine having a plurality of article dispensing devices arranged in an array, an operating system movable along X-Y axes to operate a selected dispensing device comprising:

an actuator positionable relative to and adapted to operate a selected one of said dispensing devices in the array;

a carriage supporting the actuator for movement along substantially X-Y axes to position said actuator in operative relation to the dispensing device;

first motive means for moving said carriage in a first, Y direction, including first drive means, a first member operatively coupled to said first drive means and a first element reciprocally movable along said first member;

second motive means for moving said carriage in a second, X direction, including second drive means, a second member operatively coupled to said second drive means, and a second element reciprocally movable along said second member; and control means for controlling the operation of the first and second motive means and the actuator.

2. The combination of claim 1, further including means for coupling said second motive means to said first motive means.

3. The combination of claim 2, wherein said coupling means includes a third member supported by said first element for reciprocal movement with said first element, said second motive means being supported by said third member.

4. The combination of claim 1, wherein said first motive means comprises a first motor, a first shaft rotatably coupled to said first motor, and a first traveler adapted for reciprocal movement along said first shaft upon rotation of said shaft by said motor, and said second motive means comprises a second motor, a second shaft rotatably coupled to said second motor, and a second traveler adapted for reciprocal movement along said second shaft upon rotation of said second shaft by said second motor.

5. The combination of claim 4, further including a support member attached to said first traveler, said second motive means being supported on said support member such that said second traveler is adapted to reciprocate along said second shaft independently of the reciprocal movement of said first traveler.

6. The combination of claim 5, wherein said actuator for operating a dispensing device includes means adapted for rectilinear motion and means adapted for rotational motion.

7. The combination of claim 5, further comprising an array of sensors oriented along said first and said second directions, each of said sensors operative to provide a signal indicative of the location of said first and second travelers along said first and second directions.

8. The combination of claim 7, wherein the pattern of the array of sensors corresponds substantially to the pattern of the array of the article dispensing devices.

9. A vending machine having a plurality of article dispensing devices arranged in an array, an operating system controllably movable along a first, Y direction and a second, X direction to operate a selected dispensing device, and a coin-actuated means including a merchandise article selector for controlling the operating system, said oeprating system comprising:

an actuator positionable relative to and adapted to operate a selected article dispensing device;

first motive means including a first driving means operatively coupled to a first member and a first element reciprocally movable along said first member by operation of said first drive means;

second motive means including a second drive means operatively coupled to a second member and a second element reciprocally movable along said member by operation of said second drive means, said actuator being movable with said second element;

means for coupling said first motive means and said second motive means while permitting independent operation of each of said motive means; and control means responsive to said coin-actuated means for controlling the operation of the first and second motive means and the actuator.

10. The vending machine of claim 9, wherein said coupling means includes a third member supported by said first element for reciprocal movement with said first element, said second motive means being supported by said third member.

11. The vending machine of claim 10, wherein each of said article dispensing devices includes a helical coil receiving an article of merchandise between adjacent convolutions of the coil, said coil rotatable to dispense the articles, and said actuator comprising means operable to rotate said coil.

12. The vending machine of claim 11, wherein said article dispensing device includes an element on said coil engageable by said actuator.

13. The vending machine of claim 12, wherein said actuator includes rotating means extendably supported to make driving contact with the engageable element on said coil.

14. The vending machine of claim 13, wherein:

said first motive means includes a first motor coupled to rotate a first shaft, and a first traveler reciprocally movable along said first shaft upon operation of said first motor;

said second motive means includes a second motor coupled to rotate a second shaft, and a second traveler reciprocally movable along said second shaft upon operation of said second motor; and said coupling means includes a support member secured to said first traveler, said second motive means being supported on said support member such that said second traveler is adapted to reciprocate along said second shaft independently of the reciprocal movement of said first traveler.

15. The vending machine of claim 14, further comprising an array of sensors oriented along said first and said second directions, the pattern of said array of sensors corresponding substantially to the pattern of the array of the article dispensing devices, each of said sensors operative to provide a signal indicative of the location of said first and second travelers along said first and second directions, said signal being utilized by the control means to control the operation of said first and said second motors.

16. The vending machine of claim 15, further comprising brake means operatively associated with said first shaft and said second shaft to stop substantially instantaneously rotation of each of said shafts upon stopping of said first and said second motors.

17. An operating system adapted to actuate one of a plurality of article dispensing devices arranged in an array, each of said devices operable to dispense separately articles of merchandise disposed thereon, said operating system cotnrollably movable along a first, Y direction and a second, X direction and comprising:

an actuator positionable relative to and adapted to operate a selected one of the article dispensing devices;

first motive means including a first drive means operatively coupled to a first member and a first element reciprocally movable along said first member by operation of said first drive means;

second motive means including a second drive means operatively coupled to a second member and a second element reciprocally movable along said second member by operation of said second drive means, said actuator being movable with said second element;

means for coupling said first motive means and said second motive means while permitting independent operation of each of said motive means; and control means for controlling the operation of the first and second motive means and the actuator.

18. The operating system of claim 17, wherein said coupling means includes a third member supported by said first element for reciprocal movement with said first element, said second motive means being supported by said third member.

19. The operating system of claim 18, wherein said actuator for operating a dispensing device includes means adapted for linear motion and means adapted for rotational motion.

20. The operating system of claim 18, further comprising an array of sensors oriented along said first and said second directions, each of said sensors operative to provide a signal indicative of the location of said first and second elements along said first and second directions.

21. The operating system of claim 20, wherein the pattern of the array of sensors corresponds substantially to the pattern of the array of the article dispensing devices.

22. The operating system of claim 20, wherein the signal provided by each of said sensors is utilized by the control means to control operation of said first and said second drive means.

23. The operating system of claim 18, wherein:

said first motive means includes a first motor coupled to rotate a first shaft, and a first traveler reciprocally movable along said first shaft upon operation of said first motor;

said second motive means includes a second motor coupled to rotate a second shaft, and a second traveler reciprocally movable along said second shaft upon operation of said second motor; and said coupling means includes a support member secured to said first traveler, said second motive means being supported on said support member such that said second traveler is adapted to reciprocate along said second shaft independently of the reciprocal movement of said first traveler.

24. The operating system of claim 23, further comprising brake means operatively associated with said first shaft and said second shaft to stop substantially instantaneously rotation of each of said shafts upon stopping of said first and said second motors.

25. The operating system of claim 24, wherein said brake means includes friction means controllably forced against said shafts upon stopping of said motors, and means to displace said friction means from said shafts when said motors are energized.

26. The operating system of claim 23, wherein each of the article dispensing devices includes rotatable means for dispensing separate, individual articles and said actuator for operating the dispensing device includes:

means for operative engagement with said rotatable means of said dispensing device;

a solenoid for controllably extending said engagement means into contact with said dispensing device; and a third motor for rotating said engagement means.

27. The operating system of claim 26, wherein said engagement means comprises a clutch element adapted for driving engagement with a second clutch element disposed on said dispensing device.

* * * * *